United States Patent [19]

Kishi et al.

[11] 4,417,111

[45] Nov. 22, 1983

[54] THREE-PHASE COMBINED TYPE CIRCUIT BREAKER

[75] Inventors: Tuneo Kishi; Yasuhide Takeda; Toru Tsubaki; Takeshi Takahashi, all of Hitachi, Japan

[73] Assignee: Hitachi, Ltd., Tokyo, Japan

[21] Appl. No.: 235,597

[22] Filed: Feb. 18, 1981

[30] Foreign Application Priority Data

Feb. 20, 1980 [JP] Japan ..... 55-19122

[51] Int. Cl.[3] ..... H01H 33/42

[52] U.S. Cl. ..... 200/148 R; 200/148 F

[58] Field of Search ..... 200/148 R, 148 D, 145, 200/148 F, 153 SC

[56] References Cited

U.S. PATENT DOCUMENTS

| | | | |
|---|---|---|---|
| 3,740,506 | 6/1973 | Yoshioka et al. | 200/148 F X |
| 3,857,006 | 12/1974 | Daimon et al. | 200/148 F |
| 3,943,777 | 3/1976 | Kishi et al. | 200/82 B X |
| 4,293,747 | 10/1981 | Perulfi | 200/148 F X |

*Primary Examiner*—J. R. Scott

*Attorney, Agent, or Firm*—Antonelli, Terry & Wands

[57] ABSTRACT

A three-phase combined type circuit breaker is disclosed which comprises a common housing, three-phase interrupting units in said common housing, movable contacts of the interrupting units connected through link mechanisms to operating devices for three phases respectively provided outside of the common housing, the switching operation thus being performed by phase. Rotary shafts are disposed in substantially the same plane in the link mechanisms. Each of the rotary shafts is provided with a connector for the movable contact, a connector for the operating device, and a sealing arrangement positioned between the two connectors for allowing the rotary shaft to rotate while holding the common housing in hermetic condition. This construction makes up a three-phase combined type circuit breaker capable of being operated by phase. The arrangement and construction of the three-phase rotary shafts simplifies maintenance and inspection of the interrupting units and the operating devices.

13 Claims, 6 Drawing Figures

THREE-PHASE COMBINED TYPE CIRCUIT BREAKER

BACKGROUND OF THE INVENTION

The present invention relates to a three-phase combined type circuit breaker comprising interrupting units for three-phase AC current hermetically contained in a single housing, or, more in particularly to a novel operating device for such a circuit breaker.

Generally, a three-phase combined type circuit breaker is so constructed that the interrupting units for three phases contained in a common hermetic housing are operated by a single operating device. Such a circuit breaker is disclosed in, for example, U.S. Pat. No. 3,857,006, entitled "Gas Insulated Switching Apparatus."

In conventional circuit breakers of this type, the interrupting units for three phases are actuated together to switch off the three phases in the case of an abnormality, such as lightning against one of the three phases which can be restored within a short period of time. All the conventional three-phase combined type circuit breakers so far developed are of this type.

SUMMARY OF THE INVENTION

An object of the present invention is to provide a three-phase combined type circuit breaker in which a given phase can be switched off independently of the other phases.

Another object of the present invention is to provide a three-phase combined type circuit breaker in which by reducing the volume of the common housing containing the three-phase interrupting units, the insulating medium can be easily recovered from and again filled in the common housing, respectively, before and after inspection of the interrupting units.

Still another object of the present invention is to provide a three-phase combined type circuit breaker in which the maintenance and inspection of the operating device is facilitated.

According to the present invention, the above objects are achieved by a three-phase combined type circuit breaker comprising a common housing; an operating device or drive mechanism for three phases capable of operating the three-phase interrupting units independently of each other, and an operating power transfer mechanism connecting the movable contacts of the respective interrupting units to the operating device through respective rotary shafts, which are arranged in parallel to each other and rotatably supported through rotary seals on the wall of the housing so that the interrupting units are partially located within the common housing, and partially located outside of the housing.

DESCRIPTION OF THE PREFERRED EMBODIMENTS

Figure 1:
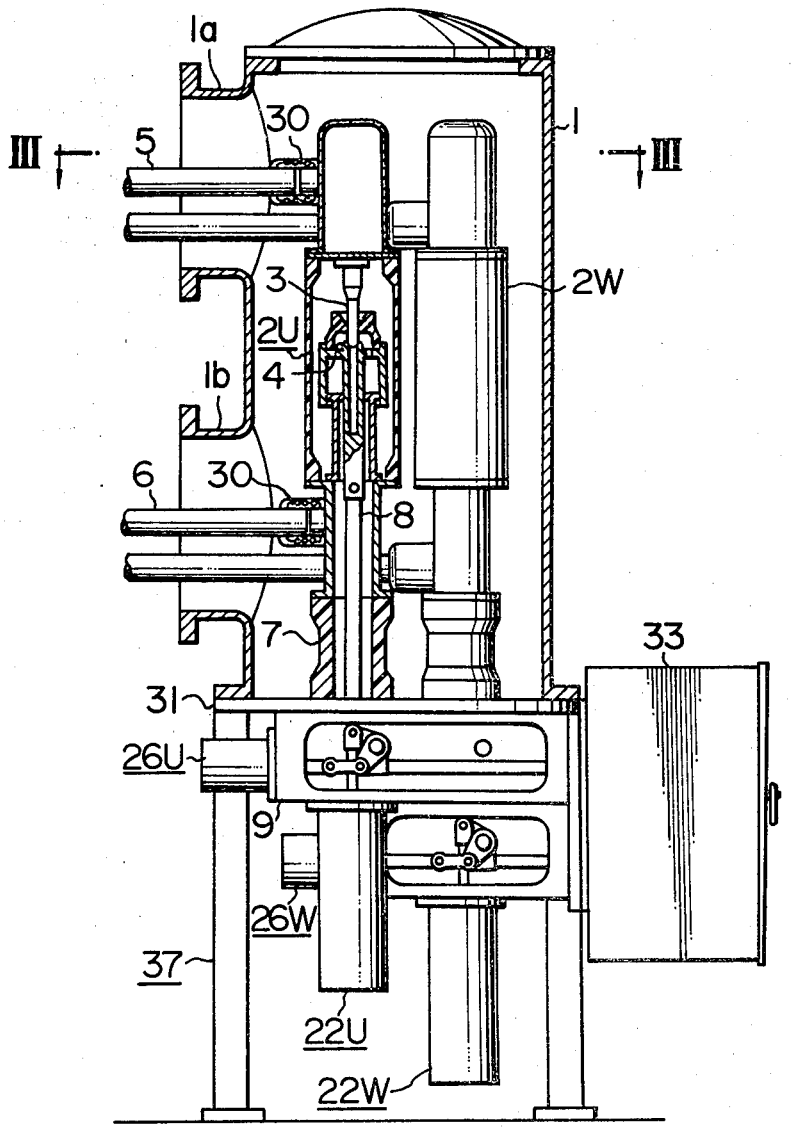
FIG. 1 is a partly cut-away sectional view of a three-phase combined type circuit breaker according to an embodiment of the present invention.
Figure 2:
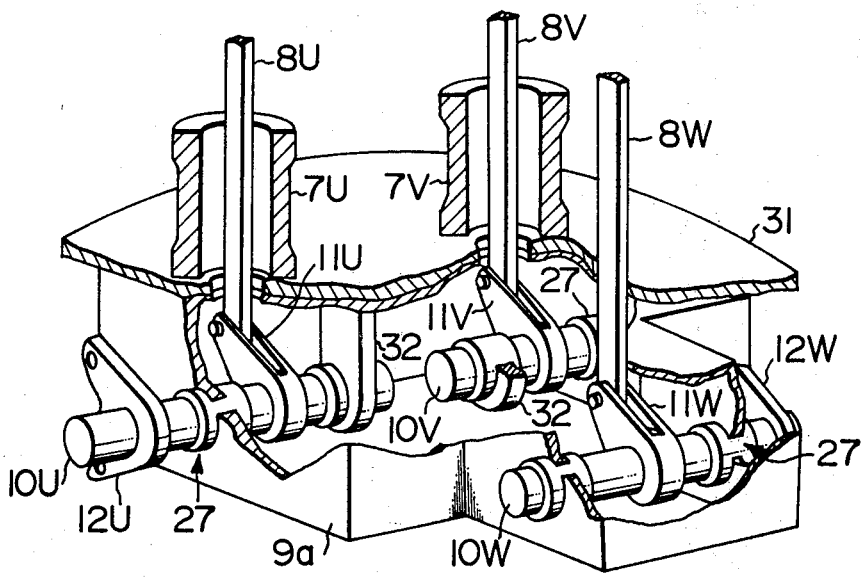
FIG. 2 is a partly cut-away perspective view of the essential parts of the circuit breaker shown in FIG. 1.
Figure 3:
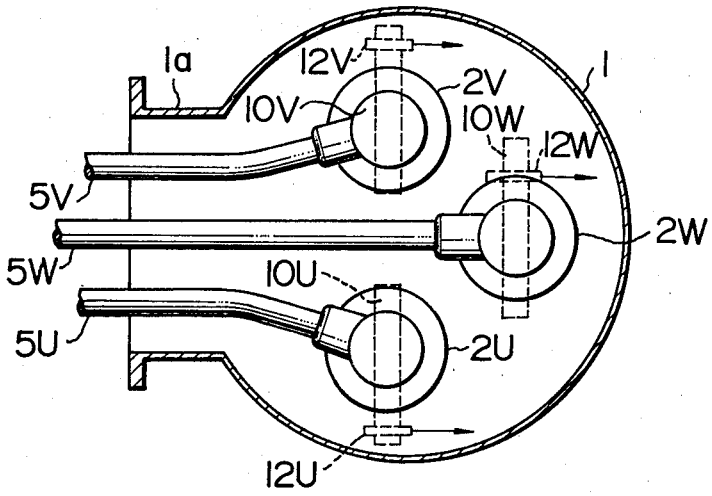
FIG. 3 is a sectional view schematically showing the circuit breaker of FIG. 1 along the line III—III.
Figure 6:
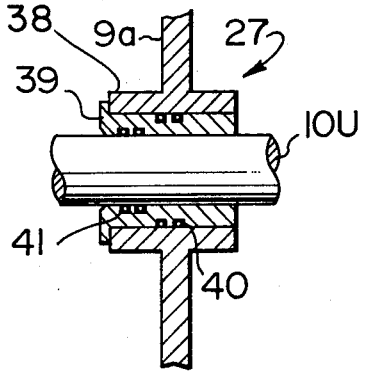
FIG. 6 is a sectional view of an arrangement for hermetically holding a rotatable part of the device.

FIG. 1 provides an example of a gas circuit breaker of a vertical type mainly used as a gas insulated switch gear, wherein three-phase interrupting units 2U, 2V and 2W are arranged within a common housing or case 1 filled with an insulating quenching medium such as $SF_6$ gas so as to be positioned at three corners of an equilateral triangle as shown most clearly in FIG. 3. Each of the interrupting units 2U, 2V, 2W is constructed as a puffer type unit, and comprises a stationary contact 3 and a movable contact 4. When the movable contact 4 is opened, a compressor is actuated to produce a compressed insulating quenching medium which is blown against the arc generated between the contacts 3,4 when separated from each other, thus quenching the arc. The common housing 1, which is cylindrical and positioned vertically, has branch tubes 1*a* and 1*b* on the sides of the axial ends thereof, which branch tubes 1*a*, 1*b* are normally sealed with an insulating spacer. The terminals of the interrupting units 2U, 2V, 2W are connected to conductors 5 and 6 within the branch tubes 1*a* and 1*b*, respectively, through collectors 30. The interrupting units 2U, 2V, 2W of each phase is supported by an insulating supporting cylinder 7 fixed on a bottom plate 31 sealing the lower opening of the common housing 1. The upper end of an insulated operating rod 8, arranged in the insulating support cylinder 7, is connected to the movable contact 4, while the lower end of the insulated operating rod 8 is led out of the common housing 1. As shown in FIG. 2, lower ends of the insulated operating rods 8U, 8V, 8W are connected in a mechanism case 9 located under the bottom plate 31 of the common housing 1, with the case 9 having a partition wall 9*a* for separating the gas space in the common housing 1 from atmosphere. The partition wall 9*a* supports three rotatable shafts 10U, 10V and 10W, with the shafts being and hermetically sealed by means of a rotational hermetic alloy holding device generally designated by the reference numeral 27, of the type shown for example in FIG. 6. More particularly, the holding device 27 includes a receptacle 38 secured integrally with the partition wall 9*a* of the mechanism case 9, with a holder 39 being arranged in the receptacle 38. The receptacle 38 is made of steel material, and the holder 39 is made of such a material as gun metal. Between the receptacle 38 and the holder 39, a seal member 40 is disposed thereby to assure the hermetic seal. The holder 39 is substantially cylindrical in form, within which a rotary shaft 10U is rotatably arranged. The sliding interface between the holder 39 and the rotary shaft 10U is maintained hermetic by the seal member 41. As shown in FIG. 2, at least one rotational hermetic holding device 27 is provided for each rotary shaft 10U, 10V, 10W. Each of the rotary shafts 10U, 10V, 10W is mechanically supported by a reinforcing member 32 through a bearing.

The three rotary shafts 10U, 10V, 10W are arranged substantially in the same plane, with the rotary shafts 10U and 10V being aligned substantially on the same axis, while the other rotary shaft 10W is arranged on another axis parallel thereto. Levers 11U, 11V and 11W are respectively secured to the three shafts 10U, 10V, 10W of the partition wall 9*a*, and have the insulated operating rods 8U, 8V and 8W coupled thereto, respectively. One end of each rotary shaft 10U, 10V, 10W is led out of the partition wall 9a and is connected with an operating device including a circuit opening mechanism and a circuit closing mechanism.

Thus, a switching system is located in the atmosphere separated from the gas space within the common housing 1, and therefor the inspection and maintenance of the system can be carried out with the gas filled in the common housing 1. According to another embodiment, the circuit closing mechanism such as a throw-in spring may be arranged on the extension of the lower end of the insulated operating rod 8, although this arrangement requires the closing switching mechanism to be disposed in a gas filled space communicated to the common housing 1, resulting in the amount of the gas to be recovered before maintenance and inspection of the interrupting units increasing, thereby increasing the time required for the maintenance. In the aforementioned embodiment however, the rotary shafts 10U, 10V, 10W for the three phases are located substantially in the same plane and a hermetic condition is maintained between part of each rotary shafts 10U, 10V, 10W and the partition wall 9a, with the result being that the height of the mechanism case 9, filled with the gas, as well as the common housing 1 may be reduced thereby to reduce the gas volume filled in.

Another advantage of this construction is that the rotary shafts 10U, 10V, 10W for three phases are arranged in parallel to each other. It would be considered that the most simple construction is to arrange the three-phase rotary shafts substantially in the shape of channel-section, as viewed from above, with two parallel shafts and one perpendicular thereto. This construction would enable the three-phase operating devices to be arranged on the three sides of the mechanism case thereby to attain the same construction for the three phases. This construction, however, is generally inconvenient for the maintenance and inspection of the operating devices and may render the gas circuit breaker bulky. Thus, this construction is comparative with the one shown in FIG. 1 in which the operating devices for three phases are arranged in a common control cubicle 33.

The connection between the outer levers 12U, 12V, 12W and the rotary shafts 10U, 10V, 10W for respective phases will be described more in detail with reference to FIG. 3. As shown in FIG. 3, the interrupting units 2U, 2V, 2W for the three phases are arranged to be located at the corners of an equilateral triangle with the base thereof on the branch tube side of the conductor 5. The rotary shafts 10U, 10V, 10W for the respective phases are arranged on axes perpendicular to the axis of the conductor 5. The rotary shafts 10U and 10V for the U and V phases are provided on the same axis, while the rotary shaft 10W for the W phase is arranged on another axis parallel thereto. It should be noted that the outer levers 12U, 12V, 12W for respective phases and the rotary shafts 10U, 10V, 10W for respective phases are connected with each other in a manner as shown in FIG. 2.

The outer levers 12U and 12V are disposed on the opposite sides to each other with respect to the rotary shafts 10U and 10V. This is desirable for the arrangement of the three-phase operating devices as mentioned later. The outer lever 12W, on the other hand, is desirably located just at the middle point between the outer levers 12U and 12V in view of the arrangement of the operating devices. The embodiment under consideration can meet this requirement as described in detail later.

In the construction of FIG. 2, explanation will be made of the coupling between the rotary shafts 10U and 10V of the U and V phases on the same axis. These rotary shafts 10U and 10V are connected to the switch driving mechanism outwardly of the couplings thereof with the insulated operating rods 8U and 8V for the interrupting units, i.e., on the opposite side ends of the rotary shafts 10U, 10V. For this reason, no problem is posed at all for the connection between the interrupting units and the rotary shafts when the interrupting units are arranged in the insulating cylinders 33 (FIG. 1) in proximity to each other to shorten the inter-phase insulating distance as well known. The switch driving mechanism may take various constructions, and therefore the fact that they are connected to the rotary shafts outside of the mechanism case makes it possible to secure more freedom for determining the size of the operating mechanism.

The outer levers 12U, 12V and 12W are secured to the ends of the rotary shafts 10U, 10V and 10W outside of the partition wall 9a, and the switch driving mechanism is connected to these outer levers. The detail of this construction will be described below with reference to FIG. 4.

As mentioned above, the operating devices for three phases are all arranged on the side of the common housing 1 nearer to the operator's passage. These operating mechanisms are shown as opening driving mechanisms 15U, 15V and 15W. Instead, they may be constructed as opening/closing drive mechanisms. The movable pistons 16U and 16V of the opening drive mechanisms 15U and 15V are connected with respective ends of the rods 17U and 17V. The other ends of the rods 17U and 17V are connected to respective ends of the L-shaped outer levers 12U and 12V, respectively. As to the W phase, if it were constructed in the same way as the other two phases, the opening drive mechanisms for the three phases would be undesirably aligned, thus enlarging the width of the operating device. In order to maintain the proper width of the operating device for W phase, a second rotary shaft 18 is provided under the rotary shaft 10W in parallel thereto, and the lever 19 on the second rotary shaft 18 is connected to the lever 12W through a rod 20. In addition, there is provided an L-shaped lever 21 having substantially the same function as the outer levers 12U and 12V for U and V phases, respectively. The construction of the two rotary shafts 10W and 18 is such that the insulated operating rod 8W and the L-shaped lever 21 are positioned in the same vertical plane. The other end of the L-shaped lever 21 is connected with an end of the rod 17W, and the other end of the rod 17W is connected with the movable piston 16W of the opening drive mechanism 15W.

In this way, the opening drive mechanisms for three phases including the movable pistons 16U, 16V and 16W are arranged to be located at the corners of an inverted triangle, thus reducing the width and height thereof. The fact that the operating mechanisms for three phases are concentrated offers great convenience for maintenance and inspection. The opening drive mechanism such as disclosed in U.S. Pat. No. 3,943,777, entitled "OPERATING APPARATUS FOR CIRCUIT BREAKER" is used, and the air filled chamber 35 including the movable piston 16U and the fixed cylinder 34 communicates with the high-pressure air source HP through a three-way valve element 36.

When the interrupting units are closed, the air-filled chamber 35 is opened to the atmosphere LP. In response to an opening command, the three-way valve element 36 is actuated thereby to cause the air-filled chamber 35 to communicate with the high-pressure air source HP. As a result, the high-pressure air that has flowed into the air-filled chamber 35 drives the movable piston 16U thereby opening the interrupting unit involved.

The other end of the three-phase L-shaped levers 12U, 12V and 21 are connected with the throw-in spring devices 22U, 22V and 22W, respectively, as circuit closing drive mechanisms. The circuit-opening and circuit-closing drive mechanisms are so related to each other than the throw-in spring device 22U, 22V, 22W is energized by the operation of the opening drive mechanism by compressed air used as a driving medium, and with the release of the opening drive mechanism from holding, the circuit is closed by the restoring force of the throw-in spring device 22U, 22V, 22W.

Further, lever pairs 23U, 23V and 24W are fixed on the sides of the L-shaped levers 12U, 12V and 12W of the rotary shafts 10U, 10V, 10W of the respective phases. The levers 23U, 23V and 24W for respective phases are connected with the movable pistons 26U, 26V and 26W of the dash pot devices 25U, 25V and 25W respectively so that the movable pistons 16U, 16V, 16W and 26U, 26V, 26W for the respective phases are driven substantially on the same axis. The connection of the levers 23U, 23V and 24W for respective phases will be described with reference to FIG. 5 representing the connection for U phase.

Figure 5:
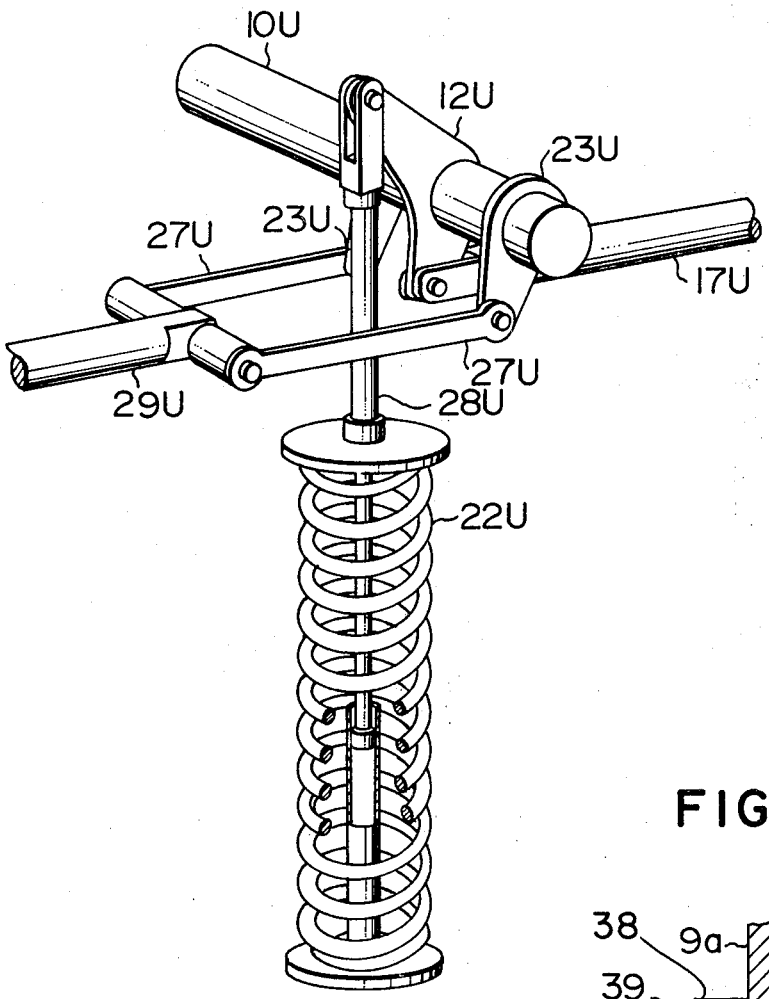
FIG. 5 is an enlarged view of the essential parts shown in FIG. 4.

As shown in FIG. 5, a pair of levers 23U are provided with the outer lever 12U therebetween and connected with links 27U, respectively. The distance between the links 27U and the axial length thereof are determined in such a manner that the rod 28U connecting an end of the throw-in spring device 22U to the outer lever 12U is freely movable between the links 27U in accordance with the rotation of the rotary shaft 10U. The other ends of the links 27U are connected to each other through the piston shaft 29U disposed therebetween. In this construction, the opening bias from the opening drive mechanism 15U is transmitted partly to the dash pot 25U and partly to the throw-in spring 22U in the directions aligned with each other. Also, the closing bias from the throw-in spring device 22U is transmitted to both the opening drive mechanism 15U and the dash pot 25U in the directions aligned with each other. If the positions of the outer lever 12U and the lever 28U are reversed, the link 27U and the rod 28U may be replaced with each other. In any way, the above-mentioned advantage is attained by constructing the rod 17U and the piston shaft 29U on substantially the same axis.

Figure 4:
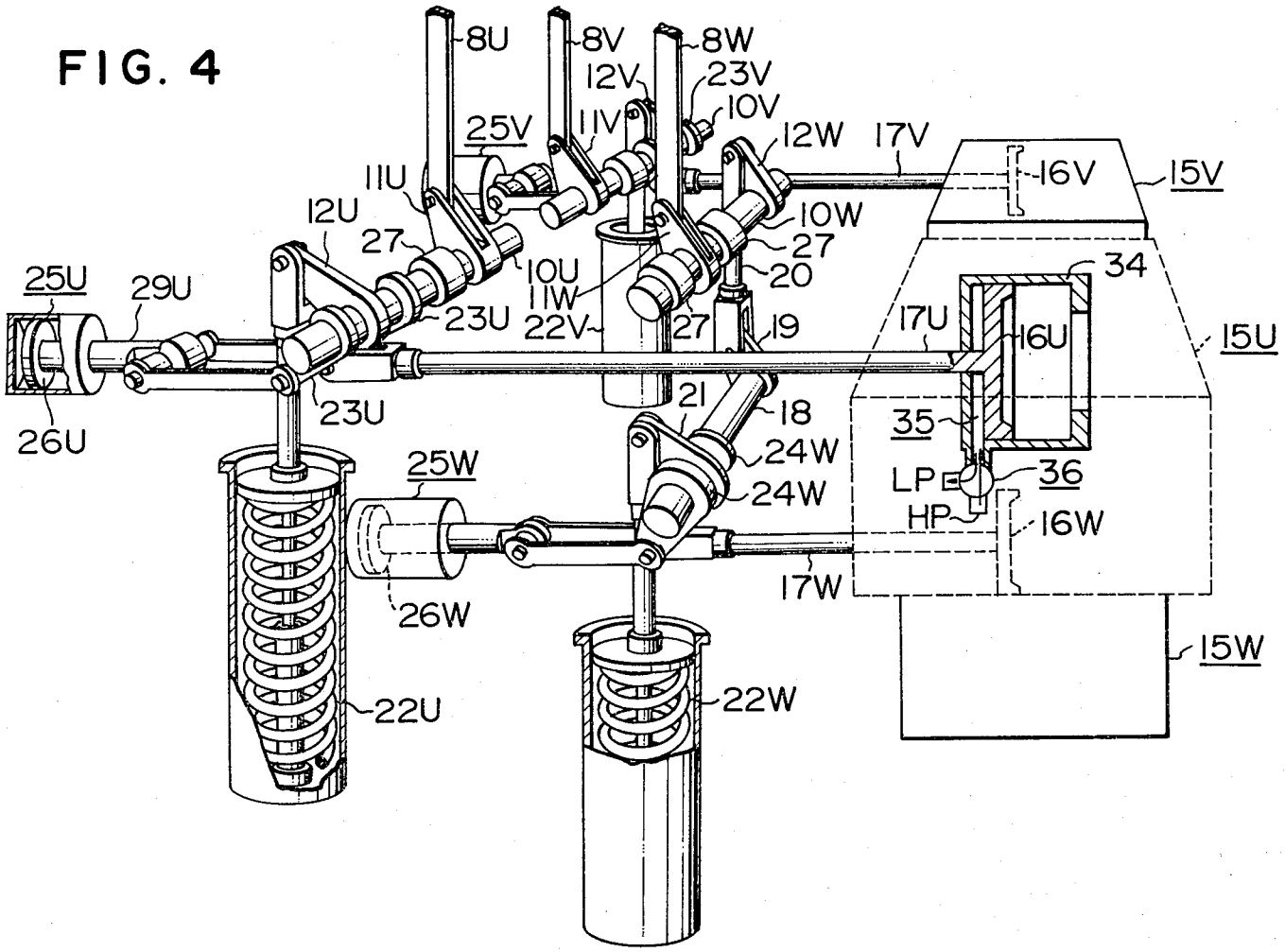
FIG. 4 is a perspective view of a driving system of the circuit breaker shown in FIG. 1.

Specifically, as seen from the embodiment shown in FIG. 4, the width and the height of the three-phase operating devices with the movable pistons 16 (the opening drive mechanisms in the embodiment shown in the drawing) may be reduced by arranging them at the corners of a triangle. For this purpose, the pistons 16 for respective phases are connected to the rods 17 parallel to each other in a substantially horizontal plane, and the ends of the rods 17 are connected to the rotary shafts 10 of the respective phases. The rotary shafts 10 for respective phases are at right angle to the rods 17 and arranged on a substantially horizontal axis, so that the rods 17, especially, the rods 17U and 17V may be connected with the rotary shafts 10U and 10V, respectively only by changing the axial length of the rotary shafts, thus simplifying the construction greatly. As for the connection of W phase involving the rod 17W, the rotary shaft 18 may be connected directly to the lever 11W to which the insulated operating rod 8W is extended with a longer axial length if the mechanism case 9 is allowed to be enlarged in volume and complicated. If, however, the two rotary shafts 10W and 18 make up a height change system, the insulated operating rods 8 for the three phases may be rendered identical to each other. Also, if the pistons 16 are arranged at the corners of an inverted triangle in the arrangement of the three-phase operating devices, the above-mentioned height change system may be unified into a simple construction.

The operating devices constructed in this way are arranged as shown in FIG. 1. The common housing 1 arranged vertically is secured to the mounting surface by the support 37. The closing drive mechanisms 22 for the three phases are disposed in the space under the support. The dash pots 26 and the opening drive mechanisms for three phases are constructed on the axes parallel to the conductors 5 and 6 respectively. If the whole apparatus is covered with a plate by use of the support, the closing drive mechanism 22 and the dash pot 26 are prevented from being exposed.

In the embodiments of the present invention, the operating device may take the form of a pneumatic operating device, a hydraulic operating device, a spring operating device or a combination of any of them. Also, at least two of the opening drive mechanism, the closing drive mechanism and the dash pot may be combined into a single device. Further, the embodiment of FIG. 4 may be modified with the rotary shaft 10W and the rotary shaft 10U interchanged with each other.

We claim:

1. A three-phase combined type circuit breaker comprising a common hermetic housing filled with an insulating medium, three-phase interrupting units each having a contact system independently operable within said hermetic housing, three phase operating devices operable independently of each other from outside of said hermetic housing, three-phase link mechanisms for connecting output terminals of said operating devices and operating force input terminals of said interrupting units by phase for operating said contact systems respectively, and three-phase hermetic alloy holding means arranged in a middle portion of each of said link mechanisms respectively for holding the hermetic condition of said hermetic housing while allowing the link mechanisms for respective phases to operate.

2. A three-phase combined type circuit breaker comprising a common housing filled with an insulating medium, interrupting units for three phases insulatively supported in said common housing and having a contact device with a selectively openable movable contact and a stationary contact, a mechanism case mechanically connected to said common housing and spacially communicated thereto, insulated operating rods for three phases each with an end connected to the movable contact of said contact device, rotary shafts for three phases each having an internal portion disposed within said mechanism case and provided with internal connecting means connected to the other end of the associated three-phase insulated operating rod and also having an external portion extending outside of said mechanism case through an opening thereof and provided with an outer connecting means, rotary seal means for three phases each provided in the opening of said mechanism case so as to provide hermetic seal between said mechanism case and the rotary shaft, while allowing said rotary shaft to rotate in said opening, and driving means for three phases operable independently of each other for operating said movable contacts through the rotation of said rotary shafts, said driving means being respectively connected to said outer connecting means of the rotary shafts for the three phases.

3. A three-phase combined type circuit breaker according to claim 2, wherein the rotary shafts for two phases among said rotary shafts for three phases are substantially aligned in a straight line, the outer connecting means for said two phases being disposed at respective end portions of said rotary shafts remote from each other, the rotary shafts for the other phase being arranged on an axis parallel to said straight line.

4. A three-phase combined type circuit breaker according to claim 2, wherein each of said driving means for three phases includes circuit opening drive means for supplying said rotary shaft with the turning effort making up the force for opening said movable contact, and closing drive means for supplying said rotary shaft with the turning effort making up the force for closing said movable contact, said insulated operating rod, said opening drive means and said closing drive means for each phase being connected to said rotary shaft in the directions of force transmission at intervals of 90 degrees with respect to each other.

5. A three-phase combined type circuit breaker according to claim 2, wherein said interrupting unit for each phase is arranged to operate vertically, and said rotary shaft for each phase is arranged substantially on a horizontal axis, and said driving means each comprises spring driving means for imparting a vertical force adapted to move the associated movable contact in one direction and hydraulic driving means for imparting a horizontal force adapted to move said associated movable contact in the other direction, said spring and hydraulic driving means being contained in a common control cubicle.

6. A three-phase combined type circuit breaker comprising a common housing filled with an insulating medium, interrupting units for three phases insulatively supported in said common housing and each having an openable movable contact and a stationary contact, a mechanism case mechanically connected and spacially communicated with said common housing, rotary shafts for three phases including an internal portion positioned within said mechanism case and an external portion positioned outside of said mechanism case, the rotary shafts for two phases being disposed substantially on the same axis, the rotary shaft for the other phase being disposed on an axis parallel thereto, internal connecting means for connecting the other end of each of said insulated operating rods for three phases to the internal portion of each of said rotary shafts, outer connecting means connected to the external portion of each of said rotary shafts, rotary seal means disposed between said two connecting means of said rotary shafts for allowing said rotary shafts for three phases to rotate while holding said common housing in hermetic condition, a second rotary shaft rotatably supported at a predetermined distance from said insulated operating rod of said rotary shaft of said other phase in opposed relation thereto, connecting means connected to said second rotary shaft, and driving means independently operated for each phase and connected to the outer connecting means respectively connected to said rotary shafts for two phases on the same axis on the one hand and to said connecting means connected to said second rotary shaft on the other hand, said driving means for each phase generating a driving force for operating said movable contact for each phase.

7. A three-phase combined type circuit breaker according to claim 6, wherein said two rotary shafts extend from inside to outside of said mechanism case in substantially opposite directions, each of said driving means for each phase including hydraulic driving means for generating an operating force for at least one of the opening and closing actions of said movable contact, said hydraulic driving means for three phases being arranged near the corners of an inverted triangle, the outputs of said hydraulic driving means for respective phase being connected to said outer connecting means of said rotary shafts for two phases on the same axis through link mechanisms respectively and also to said connecting means for the other phase.

8. A three-phase combined type circuit breaker according to claim 6, wherein said driving means for each phase comprises opening drive means for imparting an opening force for said movable contact and closing driving means for imparting a closing force for said movable contact, each of said two rotary shafts and said second rotary shaft has an L-shaped lever with an end thereof connected to said opening drive means and with the other end thereof connected to said closing drive means, and a pair of second levers coupled to the sides of said L-shaped lever, said circuit breaker further comprising dash pot devices for three phases each having a piston shaft connected to said second lever through a link.

9. A three-phase combined type circuit breaker according to claim 8, wherein said opening drive means, said closing drive means and said dash pot devices are arranged in substantially the same vertical plane in the operating directions at intervals of about 90 degrees from each other.

10. A three-phase combined type circuit breaker according to claim 1, wherein each of said three-phase link mechanisms has an end portion disposed in said housing and extending through an opening such that an opposite end portion is disposed outside of said housing, said opposite end portion of said link mechanisms being respectively connected to one of said operating devices so that when one of said operating devices is operated a corresponding one of said interrupting units is operated, and wherein said three-phase hermetic alloy holding means includes a sealing means mounted in the opening of said housing through which said link mechanisms extend for sealing the opening while allowing said link mechanisms to be independently operated.

11. A three-phase combined type circuit breaker according to claim 2, wherein said common housing defines a first space filled with said insulating medium, said interrupting units being insulatively supported in said first space, said mechanism case defining a second space, the end of the insulated operating rods connected to the movable contact device is disposed in said first space and an opposite end of each of the insulated operating rods is disposed in said second space, the internal portion of each of said rotary shafts is disposed in said second space, and wherein said driving means for the three phases is adapted to operate a connected one of said rotary shafts so that when one of said driving means is operated the rotary shaft connected thereto is rotated whereby one of said interrupting units is selectively operated.

12. A three-phase combined type circuit breaker according to claim 11, wherein each of said driving means comprises first and second driving means for separately applying first and second linear motion to the outer connecting means of the rotary shaft connected thereto, the second linear motion being in a direction substantially perpendicular to a direction of the first linear motion, said outer connecting means being adapted to convert said first linear motion into a rotary motion of said rotary shaft for opening the associated contact device and for converting the second linear motion into a rotary motion of said rotary shaft for closing said contact device.

13. A three-phase combined type circuit breaker according to claim 6, wherein the common housing includes a first space accommodating the insulating medium, said mechanism case defining a second space, insulated operating rods for the three phases are provided, each of said operating rods has an end portion disposed in said first space and operatively connected to the movable contact of a corresponding one of said interrupting units and a second end portion disposed in said second space, said rotary shafts being respectively connected to the second end portions of the insulated operating rods with the external portion of the respective rotary shafts extending through an opening in the mechanism case, said connecting means of said second rotary shaft is connected to said outer connecting means of said other of said rotary shafts for transmitting rotary movement of said second rotary shaft to said other of said rotary shafts, and wherein said driving means is adapted to move said movable contacts towards and away from said stationary contacts so as to selectively open and close the circuit breaker.

* * * * *